United States Patent [19]

Moreland et al.

[11] Patent Number: 4,561,636

[45] Date of Patent: Dec. 31, 1985

[54] FENCE POST DRIVING ASSEMBLY

[76] Inventors: Roger Moreland, East School R.R. #4, Owatonna, Minn. 55060; William Moreland, R.R. #3, Princeton, Ill. 61356

[21] Appl. No.: 523,558

[22] Filed: Aug. 16, 1983

[51] Int. Cl.[4] ..... E21B 19/00

[52] U.S. Cl. ..... 254/29 R

[58] Field of Search ..... 254/29 R, 30, 31, 124, 254/127, 326, 386; 172/111, 439

[56] References Cited

U.S. PATENT DOCUMENTS

| | | | |
|---|---|---|---|
| 2,456,852 | 12/1948 | Anderson | 254/29 R |
| 2,657,010 | 10/1953 | Sabin et al. | 254/29 R |
| 2,888,245 | 5/1959 | Anderson | 254/29 R |

*Primary Examiner*—Frederick R. Schmidt
*Assistant Examiner*—Judy J. Hartman
*Attorney, Agent, or Firm*—Neil F. Markva

[57] ABSTRACT

The fence post driving assembly is used with a vehicle having a draw bar and a three point lift arm mechanism having two outer lift arms and a safety link. The assembly is used to drive a fence post into the ground and comprises a first pulley member mounted on the draw bar of the vehicle and a second pulley member mounted at a location intermediate the two outer lift arms of the vehicle. The lift arms are movable between upper and lower working positions. A post engagement member directly contacts the top of the fence post to be driven into the ground. A line such as a cable extends from the post engagement member, around the first and second pulley members and then is anchored at the other end thereof at a location near the draw bar. The post engagement member has a lateral supporting structural configuration effective to prevent bending of a fence post when a driving force is exerted downwardly on the top of the fence post.

17 Claims, 7 Drawing Figures

FENCE POST DRIVING ASSEMBLY

FIELD OF THE INVENTION

This invention relates to an apparatus for driving fence posts into the ground using a vehicle having a hydraulically powered lifting mechanism. More particularly, the invention relates to a fence post driving assembly used with a vehicle having a draw bar and a three point lift arm mechanism having two outer lift arms and a safety link.

BACKGROUND OF THE INVENTION

There are numerous fence post driving assemblies that have been developed. A representative sample of the type of fence post driving assembly used in combination with a vehicle having a hydraulically powered or wench powered capability is shown in the following patents:

| | |
|---|---|
| 2,456,852 | 2,681,789 |
| 2,551,896 | 2,683,019 |
| 2,613,912 | 2,888,245 |
| 2,634,092 | 3,079,129 |
| 2,645,453 | 3,129,924 |
| 2,657,010 | |

The U.S. Pat. Nos. 2,645,453; 2,657,010; 2,888,245; 3,079,129; and 3,129,924 disclose the specific type of fence post driving assembly which used post engagement means for directly contacting the top of the fence post to be driven into the ground. That is, the type of fence post driving mechanism as disclosed in these patents have a top cap portion which engages the top of the fence post to be driven downwardly. One of the problems that is associated with this known type of driving assembly is that with the amount of force required to push the fence post into the ground, the fence post itself will bend with all of the force being exerted at the top thereof. This is particularly true when using the kind of forces that are associated with a vehicle such as a tractor having various types of hydraulic equipment associated therewith.

More specifically, the U.S. Pat. No. 2,888,245 discloses the type of fence post that is particularly being driven with the post driving assembly as disclosed herein. That is, the fence post is composed of metal and has a plurality of webbed flange members in angular disposition with respect to each other. In this particular instance, the cross-section of the fence post is a T-shaped configuration. When using the type cap member such as that disclosed in the Anderson U.S. Pat. No. 2,888,245, the post will bend under the force required to drive the post into the ground. Furthermore, the specific assembly as disclosed here requires the tractor to have a front end loader which must be used in combination with this fence post driving mechanism. This type of front end loading equipment is not a standard piece of equipment on most tractors. Consequently, the specific type of mechanism disclosed in this U.S. Pat. No. 2,888,245 is not widely useable.

None of the prior art fence driving assemblies disclose the basic problem of the fence post of the type being driven in this instance bending while the driving is being effectuated. The metal fence posts are particularly used for installing farm fences. The most popular method, in spite of all of the proposed automatic or hydraulically operated assemblies of the prior art, is still the hand driving method. The second most popular method is to simply use a hydraulic loader and pushing the post into the ground while another person holds onto it. This latter type of operation is extremely dangerous to the person who is holding the fence post while the front end loader of the tractor is used to push downwardly onto the top of the fence post. Furthermore, in using this latter method, the depth to which the fence post is driven cannot be controlled to any acceptable degree of uniformity.

PURPOSE OF THE INVENTION

The primary object of this invention is to provide a fence post driving assembly which will rapidly drive metal fence posts into the ground to a controlled, uniform depth.

Another object of the invention is to be able to use the standard three point lift arm mechanisms which are hydraulically powered and are a part of the vast majority of tractors which are available to farmers who would be installing fence posts of this type.

A still further object of this invention is to provide a simple assembly of structural elements making use of the draw bar and the two outer lift arms and safety link of a three point lift arm mechanism found on most tractors where there is no down pressure available on the available standard equipment.

A still further object of the invention is to be able to reverse the direction of force available in the standard three point lift arm mechanism found on farm vehicles through a pulley mechanism wherein the fence post driving assembly literally pulls the fence post into the ground a measured depth as is controlled by the upward movement of the two outer lift arms which are a part of the three point lift arm mechanism.

SUMMARY OF THE INVENTION

The fence post driving assembly as described herein uses a vehicle having a draw bar and a three point lift arm mechanism having two outer lift arms and a safety link. The assembly is designed to drive a fence post into the ground using a post engagement means which directly contacts the top of the fence post to be driven. The assembly comprises a first means for mounting a first pulley means on the draw bar of the vehicle. A second pulley means is mounted at a location intermediate the two outer lift arms of the vehicle. These lift arms are movable between upper and lower working positions. The fence post driving operation begins with the lift arms in a lower working position.

Line means such as a cable is connected at one end thereof to the post engagement means which is directly contacting the top of the fence post to be driven. The line means extends downwardly from the post engagement means under and around the first pulley means and then upwardly and over the second pulley means located between the two outer lift arms. The other end of the line means is then fixed at a location near the draw bar. With this arrangement, the upward force that is available with the three point lift arm mechanism is transformed into a downward thrust on the fence post in an approximate two to one ratio. That is, the post engagement means connected to the end of the line means moves a distance that is about twice the length of movement of the pulley means carried at a location between the two lift arms and the lift arms are moved from a lower working position to an upper working position.

Another feature of the invention is directed to the solving of the problem associated with known prior art systems. The post engagexent means has a lateral supporting structural configuration effective to prevent bending of a fence post when the driving force is exerted downwardly on the top of the fence post. The length of the metal fence post normally driven by the assembly of this invention are in the range of from 5½ to 7 feet long. There is a spade element located near the bottom end of each fence post which must be driven about 2 feet into the ground so that the spade member is buried for stabilization of the fence post. It has been found that the lateral support must be effectuated over a range of from about 12 to about 36 inches. For the shorter fence post, the length of the lateral support must be established in a range of from about 12 to about 18 inches. In a specific embodiment of this feature, the post engagement means includes an elongated channel member which receives at least one web member of the fence post and a top cap portion which is in direct contact with the upper end of the fence post being driven. The elongated channel member has a U-shaped section having two legs extending from a base section. The length of the channel section legs is effective to receive at least one webbed flange member therebetween with the outer free edge of the webbed flange member being contiguous the base section of the channel member.

Another feature of the invention is directed to the use of a line means comprising a cable encased in a spring member at a location between the post engagement means and the first pulley located at the draw bar of the three point lift arm mechanism. The spring member is effective to maintain the ordered integrity of the cable after the driving operation has been completed. That is, any slack that occurs in the cable is compensated for by the spring member which keeps the cable from becoming entangled.

In another embodiment of the invention, the post engagement means includes first vertically disposed means fixedly mounted to the first mounting means and a second vertically disposed means mounted to move along the first vertically disposed means. The second vertically disposed means includes a top cap means having a lateral support portion extending an amount effective to prevent bending of the fence post to be driven. A particular feature of this embodiment is directed to the use of two tube members which telescope with respect to each other to constitute the first and second vertically disposed means. The top cap means is defined by a channel member extending along the length of the second movably disposed tube member. The spring encased cable is disposed inside the telescoping tube members. The cap section of the post engagement means includes a downwardly directed flange means to maintain the post engagement means in contact with the top of the fence post being driven.

The cable is connected at either end using the standard cable clamping mechanisms. The post engagement means may include a series of holes either at the top or bottom thereof to enable the adjustment of the fastening position for the end of the cable attached to the post engagement means. This type of configuration provides the capability of adequately adjusting the assembly to drive various lengths of fence post.

BRIEF DESCRIPTION OF THE DRAWINGS

Other objects of this invention will appear in the following description and appended claims, reference being made to the accompanying drawings forming a part of the specification wherein like reference characters designate corresponding parts in the several views.

DETAILED DESCRIPTION

Figure 1:
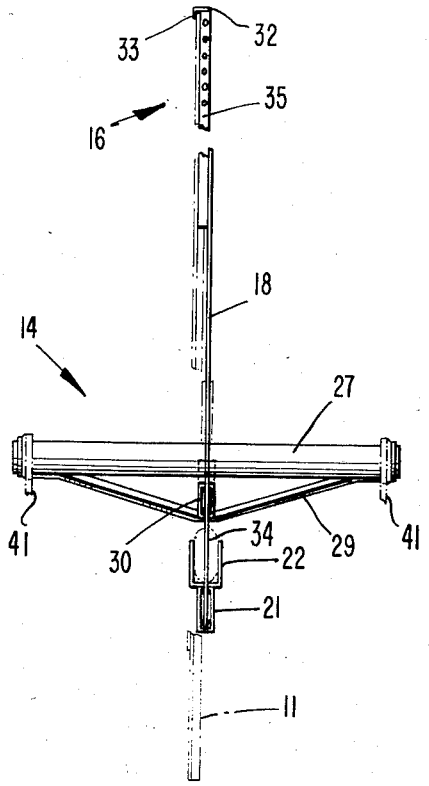
FIG. 1 is a rear elevational view of a fence post driving assembly made in accordance with this invention with the outer lift arms in a down working position.

The fence post driving mechanism, generally designated 10, comprises a draw bar bracket attachment 12, a lift arm stringer mechanism 14, a post engagement member 16 and a cable 18. The draw bar bracket attachment 12 is connected to the draw bar 25 and includes a first cable pulley member 20 and a bracket attachment body section 21. A pin hole fastening element 23 fits into the outer opening of the draw bar 25 and an anchor bolt member 24 secures the bracket attachment 12 to the draw bar 25 as shown. A connecting bracket 22 located at the top of the body section 21 is designed to be connected to the safety link 34 of the three point lift arm mechanism located at the rear end of a tractor.

The stringer mechanism 14 includes a support element 27 that is mounted between the two outer lift arms 41 of the three point lift arm mechanism. A second cable pulley member 28 is rotatably mounted in a pulley housing 30 fixedly secured to the support element 27. A pulley holding strap 29 provides reinforcement to maintaining the position of the housing 30 and pulley member 28 on the support element 27. The parts are welded together in this particular embodiment.

The post engagement member 16 includes a cap section 32 and a lateral support portion 35. The angle bracket cap section 32 has a downwardly directed flange 33 so that the engagement member 16 can fit directly over the fence post 11 and maintain its direct contact by encompassing the top edge of the fence post 11 along the fence carrying web 15. The lateral support portion 35 is defined by a U-shaped channel section having legs 36 and 37 extending outwardly from the base section 38. In this embodiment, the U-shaped channel section forming support portion 35 is composed of two L-shaped angle sections 39 and 40 bonded together via welding to form the U-shaped channel section. The length of the channel section legs 36 and 37 are effective to receive at least one web flange member 13 which is the stiffener web of fence post 11. The outer free edge of the web flange member 13 is contiguous to the base section 38 as shown.

Cable clamp 19 attaches the end of cable 18 to the bottom of the engagement member 16. Cable 18 then extends under the first cable pulley member 20 and upwardly and over the second cable pulley member 28. Cable clamp 26 anchors the other end of cable 18 to the draw bar 25.

Figure 2:
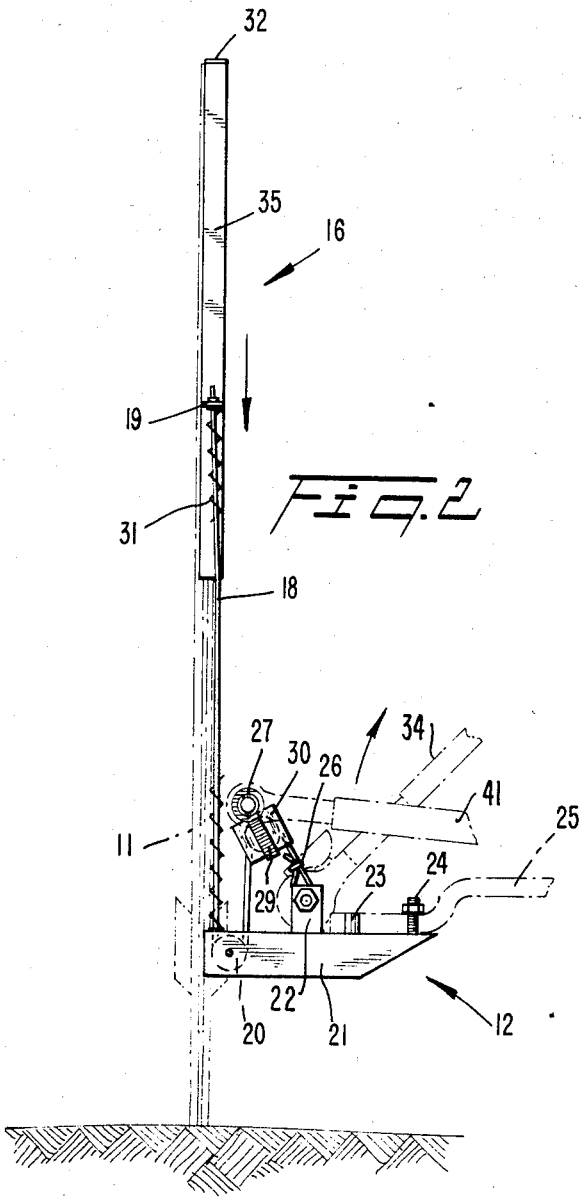
FIG. 2 is a side elevational view of the assembly as shown in FIG. 1.
Figure 3:
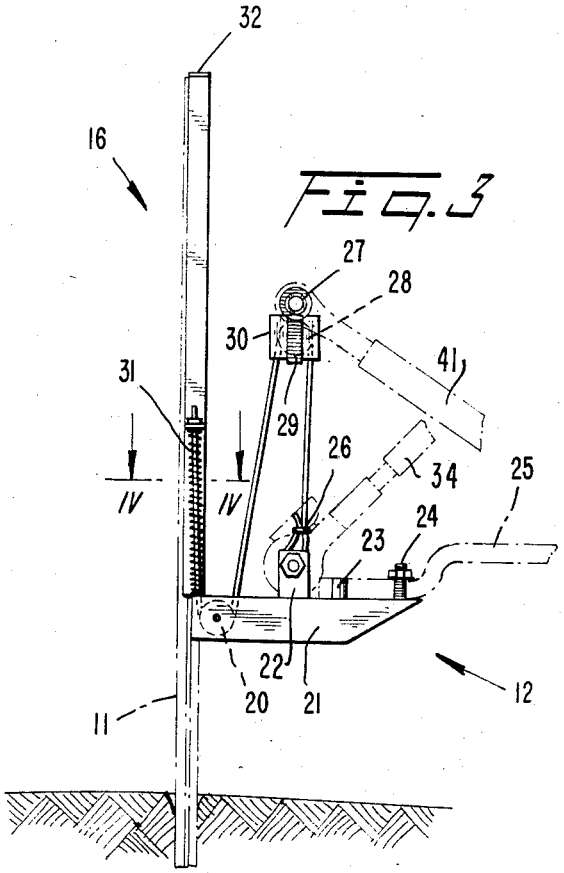
FIG. 3 is a side elevational view as in FIG. 2 with the outer lift arms in an upper working position wherein the fence post is driven into the ground.
Figure 4:
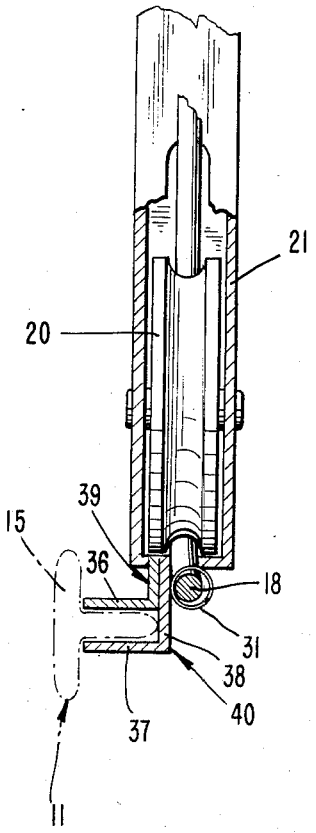
FIG. 4 is a fragmentary sectional view of the assembly taken along line IV—IV of FIG. 3.

In this particular embodiment, an engagement member 16 having a length about 30 inches is used with a fence post 11 having a height of about 7 feet. Once the engagement member 16 is in place so that the cap section 32 is over the top end of fence post 11, the lift arms 41 are raised from the lower down working position as shown in FIG. 2 to the upper position as shown in FIG. 3. As is evident in the drawings and as described herein, cable 18 is in a slack, relaxed condition when arms 41 are in the down position. With the cable 18 extending downwardly on either side of second cable pulley member 28, the post engagement member 16 moves a distance that is about twice the length of movement of the second pulley member 28 as it moves from the down position to the upper working position. In other words, cable 18 is in a taut, load pulling condition in the upper working position as shown. Since the standard three point lift arm mechanism includes a means for setting length of movement for the two outer lift arms from the lower position to the upper position, it is possible to have an automatic uniform length established for driving fence post 11 into the ground. With the safety link 34 in position on the connecting bracket 22, there is significant reinforcement that will provide the stability needed while using the hydraulic forces to effectuate the desired driving operation.

Figure 5:
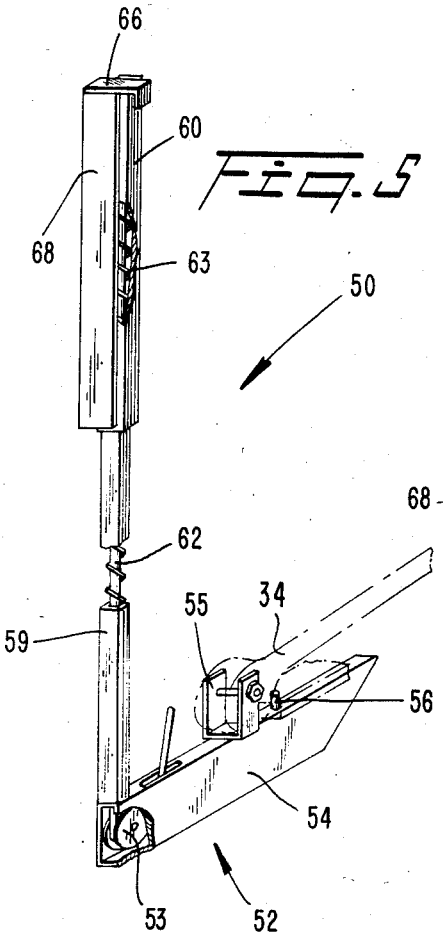
FIG. 5 is a perspective view of another embodiment of a fence post driving assembly made in accordance with this invention.
Figure 6:
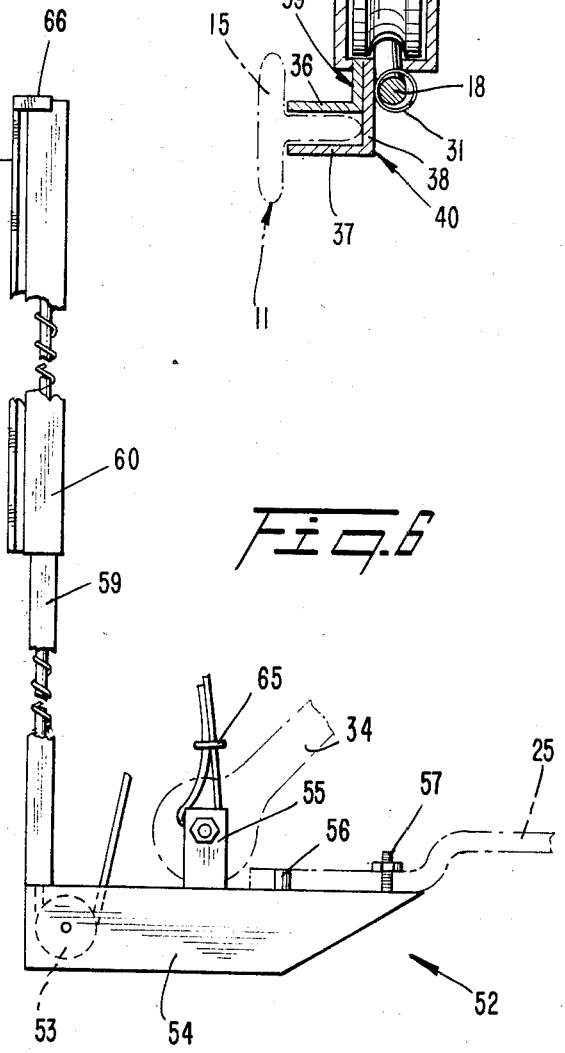
FIG. 6 is a fragmentary elevational view of the telescoping post assembly as shown in FIG. 5.
Figure 7:
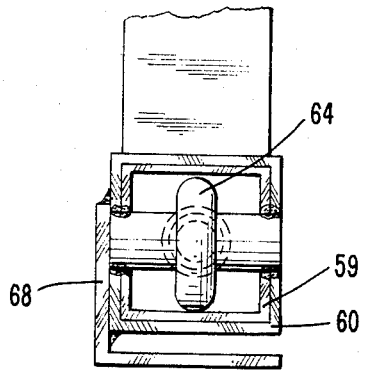
FIG. 7 is a fragmentary top plan view of the assembly shown in FIG. 5.

In the embodiment shown in FIGS. 5 through 7, the same stringer mechanism 14 may be used as described in the earlier embodiment. The specific construction of the post engagement means and primary pulley assembly is generally designated 50. The draw bar bracket attachment 52 has the first cable pulley member 53 mounted inside the body housing 54 at the outer end thereof. The housing 54 includes a pin hole fastening element 56 and an anchor bolt member 57 which attached the housing 54 to the draw bar 25 in the same fashion as shown in the earlier embodiment.

The post engagement means includes an inner tube member 59 fixedly attached to the top of the body housing 54 which includes an opening through which the cable 62 extends upwardly through the inside of the telescoped tube member 59 and 60. The outer tube member 60 is movably disposed up and down. In this specific embodiment, the tube members may have a length of from about 3 to 3½ feet.

A cable clamp 64 attaches the end of cable 62 to the upper end of the outer tube member 60. A cable clamp 65 attaches the other end of the cable to the draw bar 25 in the same manner as shown in the earlier embodiment. A cable spring 63 encases cable 62 to ensure the ordered integrity of the cable 62 so that it will not become entangled or coiled during operation of the assembly 50. The cap section 66 fits directly over the end of the metal fence post. An elongate channel member 68 is formed along the length of the movable tube member 60 to form a U-shaped channel which receives the stiffener web of the T-shaped fence post.

The operation of the assembly 50 is effectuated in the same manner as the earlier embodiment is operated.

While the fence post driving assembly has been shown and described in detail, it is obvious that this invention is not to be considered as being limited to the exact form disclosed, and that changes in detail and construction may be made therein within the scope of the invention, without departing from the spirit thereof.

Having thus set forth and disclosed the nature of this invention, what is claimed is:

1. A fence post driving assembly for use in combination with a vehicle having a draw bar and a three point lift arm mechanism having two outer lift arms and a safety link to drive a fence post into the ground, said assembly comprising:

(a) first means for mounting a first pulley means on the draw bar of the vehicle, (b) second means for mounting a second pulley means at a location intermediate the two outer lift arms of the vehicle which lift arms are movable between upper and lower working positions, (c) post engagement means for directly contacting the top of the fence post to be driven into the ground, and (d) line means for extending around said first and second pulley means and being connectable at one end thereof to the post engagement means and at the other end thereof at a location near the draw bar, (e) the post engagement means having a top cap portion and a lateral support portion extending from the cap portion a delimited length downwardly along the fencepost to be driven, (f) said delimited length being in an amount sufficient to prevent bending of said fence post being driven.

2. An assembly as defined in claim 1 wherein the fence post being driven is composed of metal and has a plurality of web flange members in angular disposition with respect to each other, and the lateral support portion includes an elongated channel member which receives at least one web member of said fence post.

3. An assembly as defined in claim 2 wherein the elongated channel member has a U-shaped section having two legs extending from the base section, the length of said channel section legs being effective to receive said at least one web flange member therebetween with the outer free edge of the web flange member being contiguous to the base section of the channel member.

4. An assembly as defined in claim 3 wherein the length of the elongated channel member is in the range of about 12 to about 36 inches.

5. An assembly as defined in claim 4 wherein the length of the elongated channel member is in the range of about 12 to about 18 inches.

6. An assembly as defined in claim 1 wherein the movement of the post engagement means is effective to drive the fence post up to two feet into the ground.

7. An assembly as defined in claim 1 wherein the top cap portion includes an angle bracket cap section which contiguously fits over the top of the fence post to be driven.

8. An assembly as defined in claim 1 wherein first engagement means connected to the end of the line means moves a distance that is about twice the length of novement of the second pulley means when the two outer lift arms of the vehicle are moved from a lower working position to an upper working position.

9. An assembly as defined in claim 1 wherein said first mounting means includes means for detachably connecting the safety link of the three point lift arm mechanism.

10. An assembly as defined in claim 1 wherein the first mounting means includes a main body portion being connectable at one end thereof to the draw bar and rotatably carrying a pulley member at the other outer end thereof.

11. An assembly as defined in claim 10 wherein the main body portion includes a bracket member having means for connecting the safety link thereto.

12. An assembly as defined in claim 1 wherein said line means includes a cable with spring means disposed around the cable at a location between the post engagement means and the first pulley means, said spring means being effective to maintain the ordered integrity of the cable after the driving operation has been completed.

13. An assembly as defined in claim 1 wherein the post engagement means includes first vertically disposed means fixedly mounted to the first mounting means and a second vertically disposed means mounted to move along said vertically disposed means, the second vertically disposed means defines said top cap portion and lateral support portion.

14. An assembly as defined in claim 13 wherein the first and second vertically disposed means comprise tube members which telescope with respect to each other with the top cap portion defined by a channel member extending along the length of the second movably disposed tube member.

15. An assembly as defined in claim 14 wherein the line means includes a cable encased in a spring member and being disposed inside the telescoping tube members.

16. An assembly as defined in claim 1 wherein the fence post being driven is composed of metal and has a plurality of web flange members in angular disposition with respect to each other.

17. An assembly as defined in claim 16 wherein the top cap portion includes a downwardly directed flange means to maintain the post engagement means with the top of the fence post being driven.

* * * * *